US005437448A

United States Patent [19]

Balson

[11] Patent Number: 5,437,448

[45] Date of Patent: Aug. 1, 1995

[54] TEE SIGHT

[76] Inventor: John E. Balson, 227 Lancaster Ave., Devon, Pa. 19333

[21] Appl. No.: 217,277

[22] Filed: Mar. 24, 1994

[51] Int. Cl.[6] ..... A63B 69/36

[52] U.S. Cl. ..... 273/187.1; 273/33

[58] Field of Search ..... 273/33, 201–212, 273/187.1, 163 R

[56] References Cited

U.S. PATENT DOCUMENTS

| | | | |
|---|---|---|---|
| D. 161,283 | 12/1950 | Rogers | 273/187.1 |
| 1,596,110 | 8/1926 | Lynch | 273/187.1 |
| 1,670,123 | 5/1928 | Ranseen | 273/212 |
| 2,128,049 | 8/1938 | Karkoska | 273/33 |
| 3,347,551 | 10/1967 | Dreyfus | 273/33 |
| 3,883,144 | 5/1975 | Lazow | 273/187.1 |
| 3,899,179 | 8/1975 | Vlach | 273/187.1 |
| 5,240,254 | 8/1993 | Adlam | 273/187.1 |

FOREIGN PATENT DOCUMENTS

| | | | |
|---|---|---|---|
| 8701047 | 2/1987 | WIPO | 273/187.1 |

*Primary Examiner*—V. Millin
*Assistant Examiner*—Steven B. Wong
*Attorney, Agent, or Firm*—Frederick J. Olsson

[57] ABSTRACT

A sight for mounting on a golf tee having a target arm to be pointed at the target by the golfer when he places the tee on the ground together with a club face alignment arm fixed to the target arm and extending outwardly on opposite sides thereof and spaced forward of the ball when the ball is on the tee whereby to be clearly seen by the golfer so that the golfer then can position the club to set up the club face parallel to the alignment arm and thereby to be set up normal to the intended flight path of the ball.

6 Claims, 1 Drawing Sheet

TEE SIGHT

The invention relates in general to golf equipment and in particular relates to a device or sight on a golf tee to assist the golfer when addressing the ball to align the club face normal to the intended flight path of the ball to the target.

The principal objective of the invention is to provide a simple, easily useable means for the golfer, at address, to position the club so that the club face is aligned normal to the intended flight path of the ball.

More specifically, the invention contemplates a golf tee and sight mounted on the tee, the sight having a target arm to be pointed at the target by the golfer when he places the tee on the ground together with a club face alignment arm fixed to the target arm and extending outwardly on opposite sides thereof and spaced forward of the ball when the ball is on the tee whereby to be clearly seen by the golfer so that the golfer then can position the club to set up the club face parallel to the alignment arm and thereby to be set up normal to the intended flight path of the ball.

The invention will be described below in connection with the following drawing wherein.

The invention is described in connection with a standard peg or plug-in-the-ground type golf tee which has a cylindrical head with a central cavity for receiving a golf ball and an elongated shank extending from the head. The head and shaft have axes which are coaxial. The shaft is adapted to be pushed into the ground so that the head supports the ball just above the ground surface. It will be apparent as the description proceeds that the invention finds utility in those tees which are placed on the ground without having a shaft or the like adapted to be pushed or plugged in the ground.

It might be noted here that the invention contemplates both a two part and a single part arrangement. In the two part arrangement, the sight is configured to be pushed on or snapped on the head of the tee. In the single part, the sight and tee are molded from plastic as a unitary piece.

Figure 1:
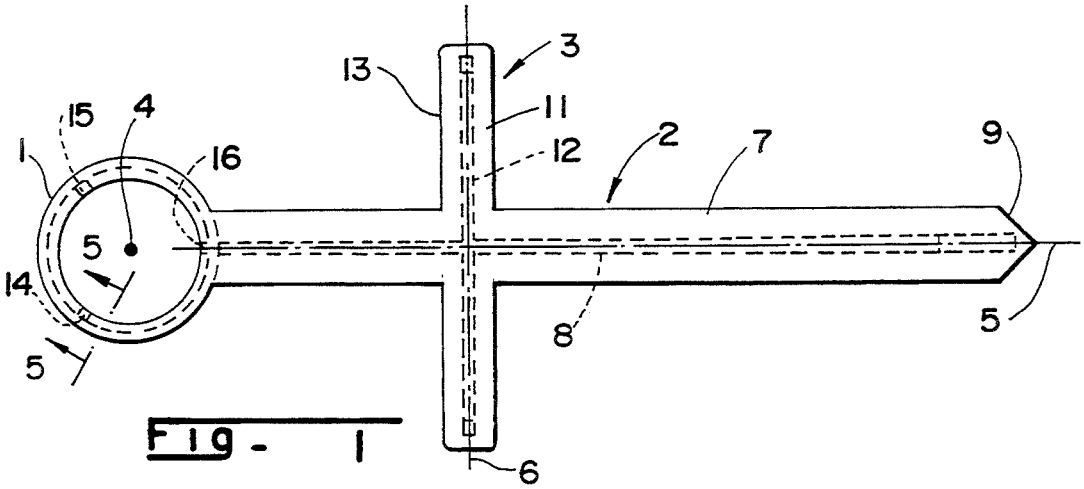
FIG. 1 is a plan view of a tee sight of the invention.
Figure 2:
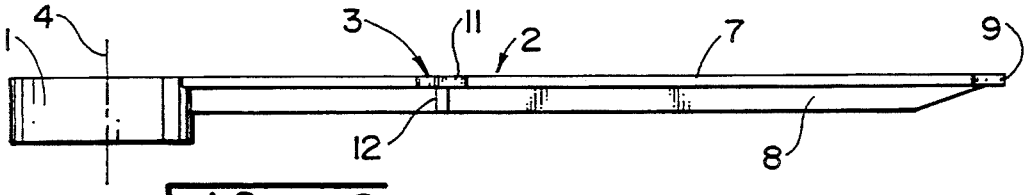
FIG. 2 is side elevational view of the sight of FIG. 1.
Figure 3:
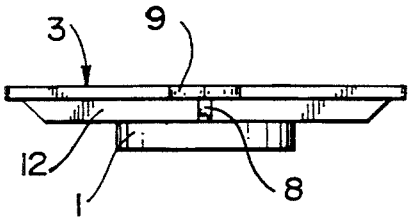
FIG. 3 is an end view looking toward the left of FIG. 1.

I will first describe the two part arrangement. Referring to FIG. 1, the principal parts of the sight are: an attachment ring in the form of a hollow, tubular body is indicated at 1; a target arm indicated at 2; and a club face alignment arm indicated at 3.

The tubular body 1 has an axis 4. The target arm 2 has an axis 5 normal to the body axis 4. The club face alignment arm has an axis 6 which is normal to the target arm axis 5. Preferably, the axes 5 and 6 are coplanar.

In the two part arrangement, the sight and tee are joined together. The hollow, tubular body 1 is pressed onto the cylindrical head of the tee. Preferably this is a snap fit and as so joined, the axis 4 of the body and the axis of the tee (running through the shank and head) are coaxial. When the tee is pushed into the ground, the head and tee sight will be above the ground.

The target arm 2 is joined with the body 1 and extends along its axis 5 radially outwardly normal to the body axis 4. The target arm 2 is comprised of a flat top 7 and a downwardly extending rib 8 on the underside of the top 7. The top 7 and rib 8 are tapered to form a pointed end 9.

The club face alignment arm 3 is joined with the target arm 2 and extends along its axis 6 normally outwardly on opposite sides of the arm 2. The alignment arm is comprised of a flat top 11 and a downwardly extending rib 12 on the underside of the top 11.

When the tee sight and tee are joined together as noted above and the shank of the tee is pushed into the ground, the golfer gets behind the tee and points the target arm to the intended target such as a point on the fairway or on the green. Thus, the target arm will be pointed along the intended flight path of the ball.

An important feature of the invention is the location of the alignment arm 3 with respect to the ball when supported on the tee and the extension of the alignment arm normally outwardly on opposite sides of the target arm 2.

The target arm 3 is spaced from the hollow tubular body 1 so that when a ball is supported by the tee, the alignment arm and particularly the inner edge 13 will not be covered or obscured by the ball whereby the arm 3 and inner edge 13 are readily seen by the golfer standing in the address position.

With the target arm pointed along the intended flight path of the ball, the alignment arm 3 and particularly the edge 13 will be normal to the flight path.

The golfer adjusts the club so that the club face is parallel to the arm 3. This is achieved by simultaneously looking at the edge 13 and the face of the club. When the club face is parallel to the arm 3 or edge 13, it will be normal to the intended flight path of the ball.

The freely viewable position of the alignment arm eliminates distraction (such as the ball partially covering the arm) and the golfer concentrates on positioning the club face with respect to the arm 3. The fact that the arm 3 extends outwardly in opposites sides of the target arm 2 contributes to the foregoing. At address, when the club face is brought up to the golf ball, the club face will extend on opposite sides of the axis 5 of the target arm and likewise the alignment arm will extend on opposite sides of the axis 5. This condition facilitates the adjustment of the club face for parallel alignment. Also, the golfer's attention is not off-set from the axis 5 of the target arm as would be the case when the alignment arm is disposed only on one side of the target arm. The ball does not interfere with or disrupt continuous sighting of the alignment arm and edge 13.

Figure 4:
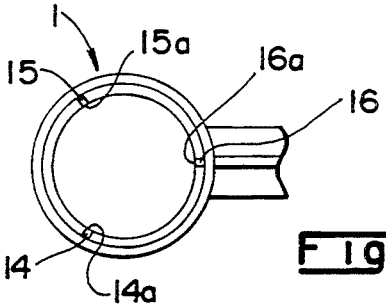
FIG. 4 is a fragmentary bottom view of a portion of the sight of FIG. 1.
Figure 5:
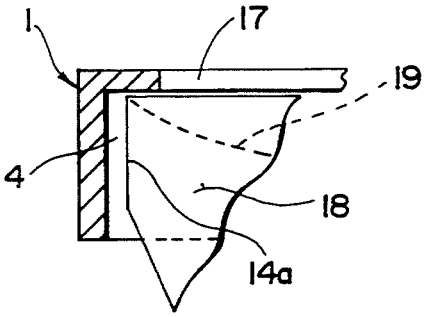
FIG. 5 is a elevational view partly in section take along the lines 5—5 of FIG. 1 and for descriptive purposes includes a portion of the cylindrical head of a golf tee.
Figure 6:
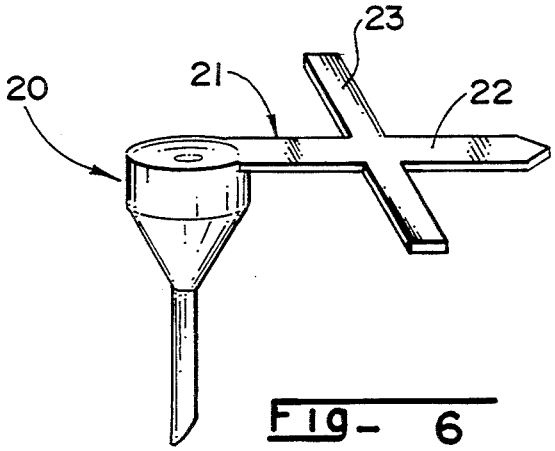
FIG. 6 is a perspective view of a golf tee and sight molded as a unitary piece.

The preferred way of joining the sight and tee together will be described in connection with FIGS. 4 and 5. The inside of the body 1 has three axially extending, equally spaced ribs 14, 15, and 16 and an inwardly extending flange 17. The ribs and the flange constitute a chamber or cavity means for receiving the cylindrical head 18 of the tee.

The hollow tubular body 1 is pressed over the cylindrical head 18 of the tee until the top of the tee engages flange 17. The inside surfaces 14*a*, 15*a* and 16*a* the ribs engage the outside wall of the head. The locus of the inside surfaces 14*a*, 15*a*, and 16*a* is a circle whose diameter is less than the outside diameter of the cylindrical head.

The approximate tolerance of a cylindrical head of a standard tee is between 0.460 and 0.480 inches. The diameter of the locus is made 0.450 inches. Therefore, when the sight is supported on the tee the inside surfaces 14*a*, 15*a*, and 16*a* will tightly grip the outside wall of the head.

As the hollow tubular body 1 is pushed on the head of the tee, the wall of the body is flexed outwardly. This has the affect of flattening the portions of the flange 17 respectively between the ribs and these portions can provide three point support means for the golf ball. When the ball is supported as described, the cavity 19 of the head provides sufficient clearance for the ball to rest in position on flange 17.

The above described flange arrangement is useful where the sight and tee are hand assembled. The overhang of the flange will insure that the body 1 and head 18 are correctly axially positioned.

The flange arrangement or the rib/flange arrangement can be eliminated especially where the assembly of the tee sight and the tee is done by machine which can always insure the same relative axial position of hollow tubular body 1 and head 18. Where the flange 17 is eliminated the ball is supported directly on the tee.

In FIG. 7, I have shown a peg type tee 20 and sight 21 molded from plastic as a unitary piece. The sight 21 has the target arm 22 and alignment arm 23 which function as previously described for arms 2 and 3.

It has been my experience that most golfers stand several feet behind the ball to assess the terrain and the target line prior to addressing the ball and completing the tee shot. For such golfers, the invention contemplates that the total length of the alignment arm be approximately the same as the diameter of the golf ball so that in standing back 6 or 7 feet the golfer will see only the ball and the target arm. The golfer's attention will not be diverted by the alignment arm. For the foregoing purposes, the length of the target arm may be increased.

I claim:

1. Golfer-aid sight means for use with a golf tee having a cylindrical head for supporting a golf ball in a position to be struck by the striking head of a golf club and be propelled along an intended path to an intended target and the cylindrical head having an axis arranged to be coaxial with a diameter of a golf ball supported on the cylindrical head, the sight means comprising:

an attachment ring having an axis, the ring to be placed over the cylindrical head of a golf tee and having means to maintain the ring on the cylindrical head with the axis of the ring and the axis of the head substantially coaxial;

a target arm connected to said ring and extending radially outwardly therefrom for use in being pointed by the golfer at the intended target when the sight means and golf tee are positioned on the ground; and a club face alignment arm connected to said target arm and extending normally outwardly on opposite sides thereof and being spaced from said axis of said ring a distance greater than the radius of a ball supported by the golf tee so that the golfer, at address, can view all of the alignment arm and thereby assist the golfer to position the club to set up the club face parallel to the alignment arm and thereby to be set up normal to the intended flight path of the ball.

2. Sight means to be mounted on the cylindrical head of a golf tee, comprising:

an attachment ring having an axis, the attachment ring being formed with a cavity to fit over the cylindrical head of a golf tee;

a target arm connected with said attachment ring and extending radially outwardly normal to the axis of said ring; and a club face alignment arm connected to said target arm and extending normally outwardly on opposite sides thereof and being spaced away from said axis.

3. The combination of a golf tee and sight means to assist the golfer, when addressing the golf ball, to align the face of the golf club normal to the intended flight path of the ball to the intended target, comprising:

said golf tee being configured to provide support for a golf ball above the ground;

said sight means including a target arm extending outwardly from said tee for use in being pointed by the golfer at the intended target of the golf ball when the tee is on the ground;

a club face alignment arm mounted on said target arm and extending normally outwardly on opposite sides therefrom and being spaced from said tee a distance greater than the radius of a golf ball supported by the tee; and said spacing of said club face alignment arm providing for the arm to be clearly viewable by the golfer when the golf ball is supported by the tee so the golfer, at address, can adjust the club to set up the club face parallel to the alignment arm and thereby normal to the intended flight path of the ball to the target.

4. The combination of a golf tee and sight means to assist the golfer when addressing the golf ball to align the face of the golf club normal to the intended flight path of the golf ball to the intended target comprising:

said golf tee having a cylindrical head and a pointed shaft to be pushed into the ground, the head and shaft having axes which are coaxial;

said sight means having an attachment ring;

said attachment ring having means making engagement with the side of said head, the engagement generating sufficient force to hold the sight means and tee together;

the inside diameter of said attachment ring being adapted to receive a portion of a golf ball and being formed with support means to be engaged by a golf ball and support the golf ball so that a diameter of the golf ball is substantially coaxial with the axis of said head;

a target arm connected to said attachment ring and extending radially outwardly therefrom for use in being pointed by the golfer at the intended target when the tee and sight means are positioned on the ground;

a club face alignment arm connected to said target arm and extending normally outwardly on opposite sides thereof and being spaced from the axis of said head a distance greater than the radius of a golf ball mounted on said support means; and said spacing of said club face alignment arm providing for the arm to be viewable by the golfer when the golf ball is mounted on said support means so that the golfer, at address, can adjust the club to set up the club face parallel to the alignment arm and thereby normal to the intended flight path of the golf ball to the target.

5. The combination of a golf tee and sight means to assist the golfer when addressing the golf ball to align the face of the golf club normal to the intended flight path of the golf ball to the intended target comprising:

said golf tee being configured to provide support for a golf ball above the ground and having a head and a pointed shaft to be pushed into the ground;

said sight means having an attachment ring;

said attachment ring having means making engagement with the side of said head, the engagement generating sufficient force to hold the sight means and tee together;

a target arm connected to said attachment ring and extending radially outwardly therefrom for use in being pointed by the golfer at the intended target when the tee and sight means are positioned on the ground;

a club face alignment arm connected to said target arm and extending normally outwardly on opposite sides thereof and being spaced from said axis a distance greater than the radius of a golf ball supported on said tee; and said spacing of said club face alignment arm providing for the arm to be viewable by the golfer when the golf ball is supported on said tee so that the golfer, at address, can adjust the club to set up the club face parallel to the alignment arm and thereby normal to the intended flight path of the golf ball to the target.

6. Golfer-aid sight means for use with a golf tee having a cylindrical head for supporting a golf ball in a position to be struck by the striking head of a golf club and be propelled along an intended path to an intended target and the cylindrical head having an axis arranged to be coaxial with a diameter of a golf ball supported on the cylindrical head, the sight means comprising:

an attachment ring having an axis, the ring to be placed over the cylindrical head of a golf tee and having means to maintain the ring on the cylindrical head with the axis of the ring and the axis of the head substantially coaxial;

a target arm connected to said ring extending radially outwardly therefrom for use in being pointed by the golfer at the intended target when the sight and tee are positioned on the ground; and a club face alignment arm connected to said target arm and extending normally outwardly on opposite sides thereof and being spaced from said axis of said ring a distance greater than the radius of a ball supported by the tee so that the golfer, at address, can view all of the alignment arm and thereby assist the golfer to position the club to set up the club face parallel to the alignment arm and thereby to be set up normal to the intended flight path of the ball and the total length of the alignment arm being approximately the same as the diameter of a golf ball supported by the tee.

* * * * *